US007210636B2

(12) United States Patent
Jäger et al.

(10) Patent No.: US 7,210,636 B2
(45) Date of Patent: May 1, 2007

(54) PROFILE TRANSITION RAIL AND METHOD FOR PRODUCING SAID RAIL

(75) Inventors: Helmut Jäger, Zeltweg (AT); Wolfgang Hölzl, Knittelfeld (AT)

(73) Assignees: VAE Eisenbahnsysteme GmbH, Zeltweg (AT); VAE GmbH, Vienna (AT)

( * ) Notice: Subject to any disclaimer, the term of this patent is extended or adjusted under 35 U.S.C. 154(b) by 141 days.

(21) Appl. No.: 10/508,817

(22) PCT Filed: Apr. 4, 2003

(86) PCT No.: PCT/AT03/00099

§ 371 (c)(1),
(2), (4) Date: Sep. 22, 2004

(87) PCT Pub. No.: WO03/084697

PCT Pub. Date: Oct. 16, 2003

(65) Prior Publication Data

US 2005/0167518 A1 Aug. 4, 2005

(30) Foreign Application Priority Data

Apr. 4, 2002 (AT) ..... A 527/2002

(51) Int. Cl.
*E01B 11/00* (2006.01)

(52) U.S. Cl. ..... 238/167

(58) Field of Classification Search ..... 238/165, 238/122, 167, 125, 151, 172, 174; 29/557, 29/890.038, 519; 72/377; 246/442, 435 R, 246/436

See application file for complete search history.

(56) References Cited

U.S. PATENT DOCUMENTS

| | | | | |
|---|---|---|---|---|
| 607,221 | A * | 7/1898 | Curtis | 238/122 |
| 2,209,725 | A * | 7/1940 | Bourland | 238/167 |
| 6,398,122 | B1 | 6/2002 | Kowalyk et al. | |

FOREIGN PATENT DOCUMENTS

| | | |
|---|---|---|
| DE | 617016 | 8/1935 |
| EP | 0 573 702 A1 | 12/1993 |

* cited by examiner

*Primary Examiner*—Mark T. Le
(74) *Attorney, Agent, or Firm*—Chapman and Cutler LLP

(57) ABSTRACT

In a transition rail (1) for the connection of rails having different rail cross sections (2, 3), the transition rail (1) comprises two transition zones (a,c), wherein in a first transition zone (c) the larger-height cross-sectional profile is reshaped to transition into a smaller profile height and in the following, second transition zone (a) the rail foot is worked to match the new profile of the consecutive rail foot. The method for producing the transition rail is characterized in that the transition rail is at first heated and introduced into a press mold, whereupon the rail is reshaped in the web region and pressed in the direction of the profile height, and that the rail foot is mechanically worked following complete reshaping.

5 Claims, 1 Drawing Sheet

PROFILE TRANSITION RAIL AND METHOD FOR PRODUCING SAID RAIL

The invention relates to a transition rail for the connection of rails having different rail cross sections and a method for producing such a transition rail.

In modern railway traffic, increasing axial loads are applied such that load limit ranges of the running track may be readily exceeded. High loads will occur in the transition zone particularly in regions or rail portions where the rolling load moves from one rail profile to another rail profile. Such transition zones are not only known in switch regions and, in particular, at the transition from standard rails to spring tongues. Asymmetric thick-web rail profiles as are used, for instance, in known spring tongue and spring rail switches for railways, must be connected to rail profiles having larger heights. During rehabilitation works on rail bodies, it may however also happen that older rail profiles will have to be adapted to more modern rail profiles, such different rail profiles differing not only in terms of height, but also in regard to the widths of their feet.

Among the known measures for the production of such transition pieces or transition rails, it was, for instance, proposed in DE 828 792 C to reforge asymmetric thick-web rail profiles into rail profiles having larger heights, the asymmetric thick-web rail profiles in that known method having been reforged to at least approximately symmetric profiles without any substantial enlargement of the profile height and the profile height having subsequently been obtained by deformation of the web.

Yet, as in DE 33 33 700 C, the transition piece in that case is formed in manner that the parameters to be changed are being changed substantially all at one time, an adaptation both of the height of the web and of the foot of the rail having been effected over the same length of the transition rail piece. A transition from one rail profile to another rail profile over as short a length as possible was to be ensured by the aid of forged fittings.

EP 1 013 826 still also departs from the conviction that a substantially continuous geometric course is to be reached in the zone of transition from one rail profile to another rail profile, appropriate adaptations having to be effected in a connection-side end region.

The invention aims to provide a transition rail of the initially defined kind, by which it is feasible to interconnect rails having different rail cross sections and rail profiles, which allows for even higher wheel loads without local overloading and stress concentration, and which, as a result, is designed to be break-proof to a higher extent than hitherto known transition rails. To solve this object, the transition rail according to the invention is essentially characterized in that the transition rail comprises two transition zones, wherein in a first transition zone the larger-height cross-sectional profile is reshaped to transition into a smaller profile height and in the following, second transition zone having the smaller profile height the rail foot is worked to match the new profile of the consecutive rail foot. As in contrast to the prior art, it is, thus, proposed according to the invention to carry out the required adaptations separately in spatially separated transition zones and merely reduce the profile height in a first partial region and adapt the rail foot to the new profile only in a spatially separated, further partial region. A reduction of the profile height, as is obtained in a particularly simple manner by upsetting or pressing, naturally results in an increase of other dimensions and, in particular, the width of the foot in this partial region under an appropriate lateral pressing force exerted on the web. Due to the fact that no additional method steps or shape adaptation steps are, at the same time, carried out in such changing partial regions, it has now surprisingly turned out that stress concentrations as observed in configurations in which height and foot-width profile changes are effected in the same cross section will no longer occur and that, overall, the breaking resistance of such a transition rail can, therefore, be substantially enhanced even under extreme axial loads. This surprising result could subsequently be verified by a computational model in which a stress determination was appropriately modeled by a finite elements model. In that computational model, the axial force occurring was introduced as a surface pressure, and it could be demonstrated that the stress concentrations clearly observed with known configurations would no longer occur. Between the two partial regions separately adapted to the respectively new geometry, also a neutral intermediate region, i.e., a region of constant cross-sectional shape, may preferably be provided in order to obtain a further stress concentration reduction between the two deformation zones.

A further preferred configuration will result if the second transition zone, to which the lower profile height has already been imparted and whose rail foot has been worked to match the new profile of the consecutive rail foot, is arranged closer to the free end of the transition rail than the first transition zone. On the free end of the transition rail, welding with the connector rail having the smaller profile height and the modified rail foot is effected, whereby, due to the fact that the second, merely mechanically worked transition zone is arranged closer to the welding site, stress concentrations as might possibly occur in the first transition zone formed by reshaping will be kept away from the welding site.

The method according to the invention, for producing a transition rail of this type is essentially characterized in that the transition rail is at first heated and introduced into a press mold, whereupon the rail is reshaped in the web region and pressed in the direction of the profile height, and that the rail foot is mechanically worked following complete reshaping. By merely effecting pressing in a first method step after heating, it is feasible to deform the transition rail to the desired profile height, wherein, by using a press form, also the web width can be brought to the desired measure, or kept at the desired measure. It is only after such a complete reshaping naturally extending over a defined axial length of the transition rail that the second adaptation is effected, the rail foot being mechanically worked after this. In doing so, the rail foot is advantageously machined, thus at the same time enabling the realization of the transition from a wider to a narrower rail foot with an appropriate rounding while observing defined radii. In this respect, the configuration is advantageously devised such that the transition zone of the rail foot, in which the width of the rail foot increases or decreases, is designed to be rounded in top view, thus further lowering the risk of cracks in this transition zone.

The invention allows for the production of suitable transition rail pieces separately from the two rails, whereby such a transition piece can be connected with the modified rail profile at the factory in a particularly simple manner by flash welding with a connection rail piece such that the subsequent installation into a track will be further simplified and additional welding procedures will no longer affect the region of the transition rail in any manner whatsoever.

In the following, the invention will be explained in more detail by way of an exemplary embodiment schematically illustrated in the drawing. Therein, FIG. 1 is a side view of a rail course including an installed transition piece;

Figure 1:
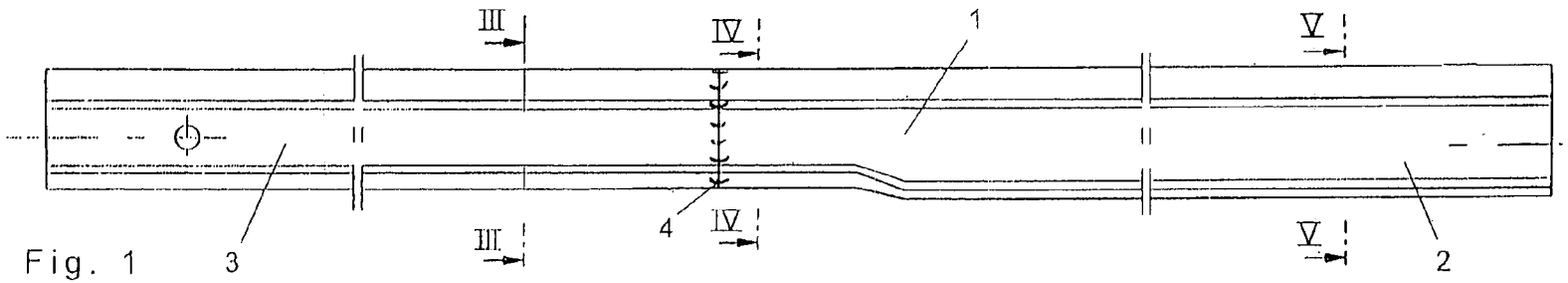
Figure 2:
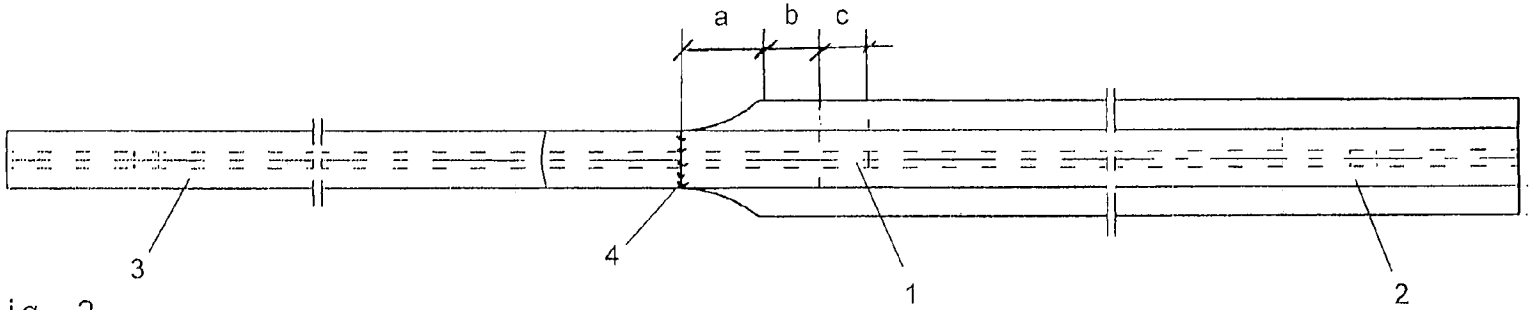
FIG. 2 is a top view on the illustration according to FIG. 1.
Figure 4:
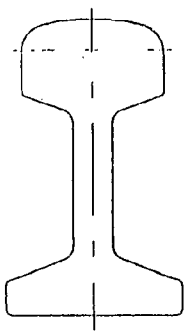
FIG. 4 is a section along line IV/IV of FIG. 1.
Figure 5:
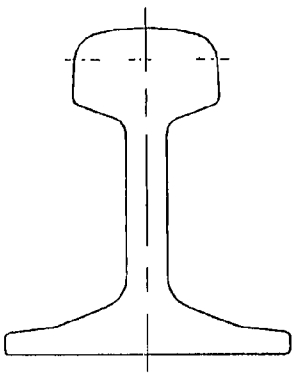
FIG. 5 is a section along line V/V of FIG. 1.

In FIG. 1, a transition rail is denoted by 1, which, departing from a standard rail profile 2, enables the transition to another rail profile 3. The transition rail 1 is connected by welding with the standard rail having a modified profile height 3, the respective weld being denoted by 4. The transition rail region 1 comprises portions a, b and c with portion a having already been pressed to a reduced profile height and worked merely in the rail foot region. As is apparent, in particular, from FIG. 2, such working involves machining of the rail foot at a rounding radius r=120–150. In the configuration according to FIGS. 1 and 2, zone b is designed as a substantially neutral region in which the rail foot has not yet been worked in its width but merely adapted in terms of profile height to the new conditions by reforging or pressing. That forging or pressing procedure takes place in the first transition-rail partial region c adjacent to the standard rail 2, with pressing forces being at the same time applied in the height direction and transverse to the web, as is particularly apparent from the cross sections according to FIGS. 3, 4 and 5.

Figure 3:
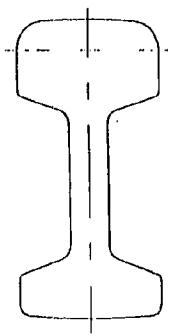
FIG. 3 is a section along line III/III of FIG. 1.

FIG. 3 depicts the final connection profile having the modified rail height and the modified web width corresponding to rail portion 3. This profile shape corresponding to the section according to line III/III of FIG. 1, thus, corresponds with the profile capable of being welded with the transition rail. The cut IV/IV illustrated in FIG. 4 was laid in the region of the transition rail itself. From this illustration it is apparent that merely the rail foot is different from its desired width and consequently still needs to be machined to the desired width. The initial profile corresponding to rail 2 is characterized by substantially wider rail webs and a larger profile height. This initial profile corresponds to the section along line V/V and is apparent from FIG. 5. When comparing the profiles according to FIGS. 3, 4 and 5, it is immediately apparent that the head profile in the region of the transition rail and between the two interconnected rails is not modified at all. The web has become slightly narrower at the transition from rail 2 to rail 3, from which it can be taken that, in the context of the deformation of the rail having the profile according to FIG. 5 into a rail having the profile according to FIG. 4, not only forces acting in the height direction to upset the profile height, but also lateral pressing forces were at the same time applied in order to appropriately delimit the web width. In such a deformation step, the region of the rail foot naturally changes and the final working of the rail foot is effected in a partial region of the length of the transition rail, in which partial region the deformation by forging, or deformation by pressing, has already been completed, and consecutive to such a partial region.

The invention claimed is:

1. A transition rail for connection of rails having different rail cross sections, wherein the transition rail (1) comprises two transition zones (a, c), wherein in a first transition zone (c) a larger-height cross-sectional profile is reshaped to transition into a smaller profile height while the width profile of a rail foot is kept constant, and in a following, second transition zone (a) having the smaller profile height, the width profile of the rail foot is changed to match a new width profile of a consecutive rail foot while the profile height is kept constant.

2. A transition rail according to claim 1, wherein the second transition zone (a) is arranged closer to a free end of the transition rail (1) than is the first transition zone (c).

3. A transition rail according to claim 1, wherein a zone (b) of constant cross-sectional shape is arranged between the first transition zone (c) and the second transition zone (a).

4. A transition rail according to claim 2, wherein a zone (b) of constant cross-sectional shape is arranged between the first transition zone (c) and the second transition zone (a).

5. A transition rail according to claim 1, wherein the second transition zone of the rail foot, in which the width of the rail foot decreases, is designed to be rounded in top view.

* * * * *